United States Patent [19]

Etes

[11] 4,030,586

[45] June 21, 1977

[54] PLURAL COIN RESPONSIVE MECHANISM FOR A DISPENSING MACHINE

[76] Inventor: Elmer G. Etes, 1436 Blaisdell St., Rockford, Ill. 61103

[22] Filed: July 9, 1975

[21] Appl. No.: 594,535

[52] U.S. Cl. ..... 194/59; 194/DIG. 2

[51] Int. Cl.[2] ..... G07F 5/08

[58] Field of Search ..... 194/54–59, 194/1 G, DIG. 2

[56] References Cited

UNITED STATES PATENTS

| | | | |
|---|---|---|---|
| 1,220,102 | 3/1917 | Hall | 194/DIG. 2 |
| 3,174,608 | 3/1965 | Knickerbocker | 194/54 |
| 3,503,482 | 3/1970 | Davis | 194/54 |
| 3,760,923 | 9/1973 | Voegeli | 194/1 G |
| 3,884,330 | 5/1975 | Chalabian | 194/59 |

*Primary Examiner*—Drayton E. Hoffman
*Assistant Examiner*—Francis J. Bartuska
*Attorney, Agent, or Firm*—Morsbach & Pillote

[57] ABSTRACT

A coin responsive mechanism for controlling operation of a dispensing machine including a coin chute adapted to receive coins of several different denominations to provide a gravity drop for coins from a coin receiving slot to a coin stop, the coin chute having slots at opposite sides with a first gauging pawl mounted for movement through the slot in one side to block upward movement of a first combination of coins in the chute and a second gauging pawl mounted for movement to the slot in the other side of the chute to block upward movement of the second combination of coins in the chute. The gauging pawls are adjustable along the chute to adapt the mechanism to respond to a wide variety of combination of coins of different sizes and different denominations. Provision is made for selectively rendering certain of the gauging pawls inoperative while others are rendered operative and vice versa to adapt the coin responsive mechanism for use in machines such as newspaper vending machines which must be actuated for week-day editions in response to coin combinations having one preselected total monetary value and which must be actuated to dispense Sunday editions in response to coin combinations having a different total monetary value.

7 Claims, 11 Drawing Figures

PLURAL COIN RESPONSIVE MECHANISM FOR A DISPENSING MACHINE

BACKGROUND OF THE INVENTION

Coin operated dispensing mechanisms have heretofore been made, for example as shown in U.S. Pat. Nos. 2,925,898; 3,403,765 and 3,550,744, having a coin chute providing a gravity drop for coins from a coin receiving slot to a coin stop and with coin gauging pawls extending into one side of the coin chute to provide abutments for engaging certain combination of coins in the chute to block upward movement of the same and thereby control operation of the dispensing mechanism. However, it is frequently desirable to control operation of the dispensing mechanism in response to various different combinations of the coins including coins of several different denominations. Some of the prior coin responsive mechanisms, for example those shown in the aforementioned U.S. Pats. Nos. 2,925,898 and 3,403,765 utilize multiple coin chutes in order to accommodate various different combinations of coins of different denominations. Such coin responsive mechanisms are relatively complex and expensive not only because of duplication of the number of coin chutes, but also because of the increased complexity of the mechanisms for sensing the different combinations of coins in the several chutes and for controlling operation of the dispensing mechanism in response to coins in either one or the other or both chutes.

There are also dispensing machines, for example machines for dispensing newspapers, which must be operated part time for example during dispensing of weekly newspapers, in response to different coin combinations having one total monetary value and must be operated at other times, for example when dispensing Sunday newspapers, in response to coin combinations having a different total monetary value. It has been proposed, for example as shown in the aforementioned U.S. Pat. No. 2,925,898, to provide two sets of pawls, one for gauging coin combinations corresponding to the monetary value of daily newspapers and others for gauging coin combinations corresponding to the monetary value of Sunday newspapers, and to selectively hold back the Sunday pawls by clamp on week days. However, the multiple chute type coin responsive mechanism further complicates this type of operation.

SUMMARY OF THE INVENTION

The present invention relates generally to coin responsive mechanism for controlling operation of a dispensing machine.

An important object of this invention is to provide a coin responsive mechanism for a dispensing machine which is adapted to sense and control operation of the dispensing machine in response to a wide variety of different coin combinations including coins of different sizes and denominations.

Another object of this invention is to provide a coin responsive mechanism for a dispensing machine which utilizes a single coin chute for gauging different combinations of coins of different size and denominations.

Still another object of this invention is to provide a coin responsive mechanism for a dispensing machine which can be readily adapted for a two mode operation to gauge coin combinations having one total monetary value at one time and coin combinations having a different total monetary value at another time.

A more particular object of this invention is to provide a coin responsive mechanism for dispensing machines having a single coin chute and coin gauging pawl means mounted on opposite sides of the chute to extend thereinto to sense various different combinations of coins.

Yet another object of this invention is to provide a coin responsive mechanism for a dispensing machine adapted for gauging a wide variety of coin combinations, and which is a simple and economical construction and which is reliable in operation.

The coin responsive mechanism includes a coin chute which is dimensioned to receive coins of several different denominations and provide a gravity drop for the coins from a coin receiving slot to a coin stop at the lower end of the chute. An important feature of the present invention resides in the provision of a coin chute having slots in opposite sides with a first gauging pawl means mounted to extend through the slot in one side to block upward movement of at least one preselected combination of coins in the chute and a second gauging pawl means mounted for movement through the slot in the other side of the chute to block upward movement of at least one other preselected combination of coins in the chute. The gauging pawls at each side of the chute are adjustable along the slots to adapt the mechanism for sensing different coin combinations. The slots in the opposite sides of the chute are advantageously offset so that the wall at one side of the chute partially overlaps the slot at the other side to provide a stop for engaging the pawl extending in through the slot at the opposite side.

In another aspect of the present invention, the coin responsive mechanism can be adapted for a two mode operation, for example for dispensing daily and Sunday newspapers, by adjusting the pawls at one side of the chute to sense coin combinations having a preselected monetary value corresponding to the daily newspaper price and by adjusting the pawls at the other side of the chute to sense the coin combinations having a different monetary value corresponding to the Sunday newspaper price, and by the provision of mechanism for selectively rendering one or the other sets of pawls inactive.

In still another aspect, the pawls at both sides of the chute can be utilized simultaneously to increase the range of coin combinations that can be sensed and to sense different coin combinations having only small differences in total height in the chute.

In a further aspect of the invention, the coin responsive mechanism is adapted for sensing coin combinations of widely different monetary value by forming the coin chute of a depth between the side walls sufficient to receive a nickel and a width between the end walls of the chute sufficient to accommodate the diameter of a quarter so that a single chute can receive dimes, nickels, and quarters.

These, together with other objects, advantages and features of this invention, will be more readily understood by reference to the following detailed description when taken in connection with the accompanying drawings wherein.

Figure 1:
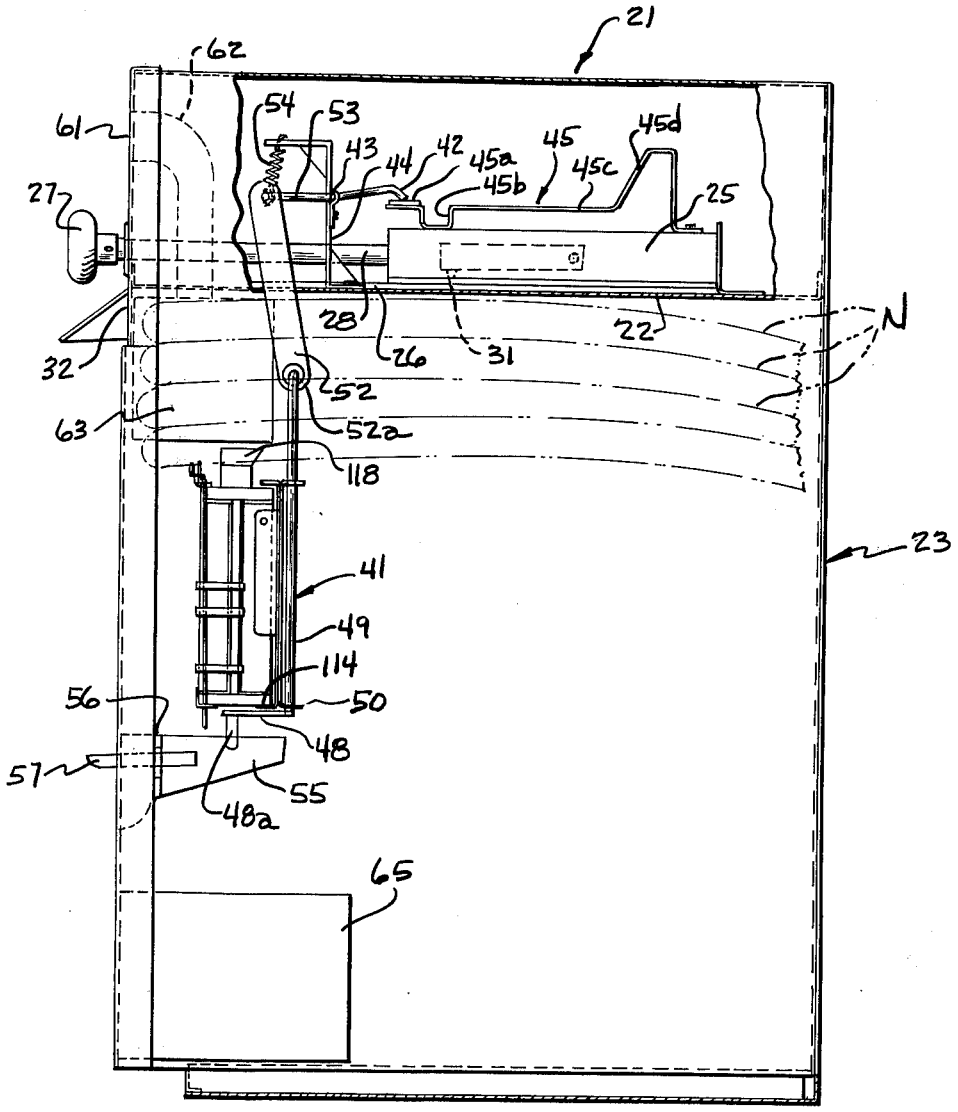
FIG. 1 is a side elevational view of a vending machine embodying the coin responsive mechanism of the present invention and with parts broken away and shown in section to illustrate details of the construction.

The coin responsive mechanism of the present invention is generally adapted for use in controlling operation of a dispensing machine to provide a coin operated dispenser and is shown in FIG. 1 applied to a newspaper vending machine designated generally by the numeral 21. A newspaper vending machine can be of any suitable construction and the vending machine herein illustrated is of the type shown in the applicant's prior U.S. Pat. No. 3,114,475 issued Dec. 17, 1963 to which reference is made for a more complete illustration and description of the vending machine. In general, the vending machine is adapted for dispensing newspapers, magazines and the like herein sometimes referred to as papers, and the machine includes a top dispensing panel 22 mounted in a housing 23 at a level somewhat below the top of the housing and having a mechanism (not shown) for advancing a stack of papers designated N upwardly into engagement with the underside of the dispensing panel 22. A paper dispensing mechanism is mounted in the housing on the upper side of the panel 22 and includes a slide 25 mounted on a guideway 26 for reciprocation in response to manual pulling on a knob 27 connected to the slide through a rod or stiff cable 28. As more fully disclosed in the aforementioned U.S. Pat. No. 3,114,475, the slide 25 operates during forward movement to project a paper engaging pin 31 downwardly through a slot (not shown) in the dispensing panel 22 to impale the topmost paper in the stack and to thereafter advance the pin and paper forwardly with the slide to project the forward portion of the top paper through the dispensing opening 32 at the front of the housing. The paper engaging pin 31 is retracted with slide 25 when it is moved back to the position shown in FIG. 1, and the pin is preferably raised to a position above the dispensing panel 22 during retraction of the slide 25 to prevent scoring of the paper at the top of the stack.

The coin responsive mechanism 41 of the present invention is herein shown substituted for the coin mechanism disclosed in the aforementioned U.S. Pat. No. 3,114,475. A latch means is provided to normally prevent movement of the slide 25 in a dispensing operation or cycle and the coin responsive mechanism 41 is arranged to control operation of the latch to release the latch and allow movement of the dispensing member in a dispensing cycle only when the coin responsive mechanism senses a combination of coins having the proper monetary value. As shown in FIG. 1, the latch mechanism includes a latch finger 42 mounted for vertical swinging movement about a pintle 43 on a bracket 44 conveniently supported on the dispensing panel 22. A cam track 45 is mounted for movement with the slide 25 and includes a first dwell portion 45*a* arranged to engage the latch finger 42 and support the same when the dispensing member 25 is in its fully retracted position shown in FIG. 1. A coin stop 48 is positioned below the lower end of the coin responsive mechanism 41 and is connected through a rod 49 supported by guides 50 and through a means such as a link 52 with an arm 53 connected to the pintle 43 at the side thereof opposite the latch finger 42. A spring 54 is connected to the arm 53 to yieldably bias the latch finger 42 against the first dwell portion 45*a* and thereby move the coin stop 48 to a preselected position below the coin responsive mechanism 41 determined by the first dwell portion 45*a*. The cam track 45 also has a notch 45*b* that extends below the level of the dwell portion 45*a* and to define a stop. As the dispensing member 25 moves forwardly in a dispensing stroke, the latch finger 42 can move downwardly under the bias of spring 54 and drop into the notch to thereby stop further forward movement of the dispensing member. However, if the proper combination of coins is present in the coin responsive mechanism 41, the coin responsive mechanism operates to limit upward movement of the coin stop and thereby limit downward movement of the latch finger 42. The cam track has a second dwell portion 45*c* that extends from a notch 45*b* in a direction rearwardly and parallel to the path of travel of the dispensing member.

At least the lead end of the second dwell portion 45*c* is disposed at a level slightly below the level of the dwell portion 45*a* to prevent latch finger from engaging the stop notch, if the coin stop 48 moves upwardly only a slight distance, for example of the order of 1/16 of an inch from the position shown in FIG. 1, as the slide 25 is moved in a forward dispensing stroke. The cam track has a cam face 45*d* which is arranged to engage the stop finger 42 when the dispensing member approaches the end of its forward dispensing stroke to raise the latch finger and hence depress or lower the coin stop 48 to allow discharge of coins from the coin responsive mechanism 41. A coin return mechanism is preferably provided to enable selective return of coins from the dispensing mechanism 41. The coin return mechanism may, for example, include a coin return chute 55 swingably mounted at 56 on the housing for movement into and out of a position below the coin responsive mechanism 41 by a manually operable lever 57. The coin chute 55 is arranged to engage a finger 48*a* on the coin stop 48 and swing the latter about the axis of rod 49 away from a position below the coin responsive mechanism when the coin return chute is moved into position below the coin responsive mechanism to receive coins. The rod 49 has its upper end mounted in a resilient grommet 52*a* on the link 52 to allow such swinging movement of the coin stop about the axis of rod 49.

The coin responsive mechanism is arranged to receive coins from a coin slot 61 and coins are guided from the slot through a coin chute 62 shown in phantom in FIG. 1 and through a conventional slug ejector mechanism 63 to the coin responsive mechanism 41. Coins from the coin responsive mechanism are discharged to a coin receptacle 65 at the end of a dispensing cycle unless the coin return mechanism is operated prior to dispensing a paper to return the coins by way of the return chute 55.

Figure 4:
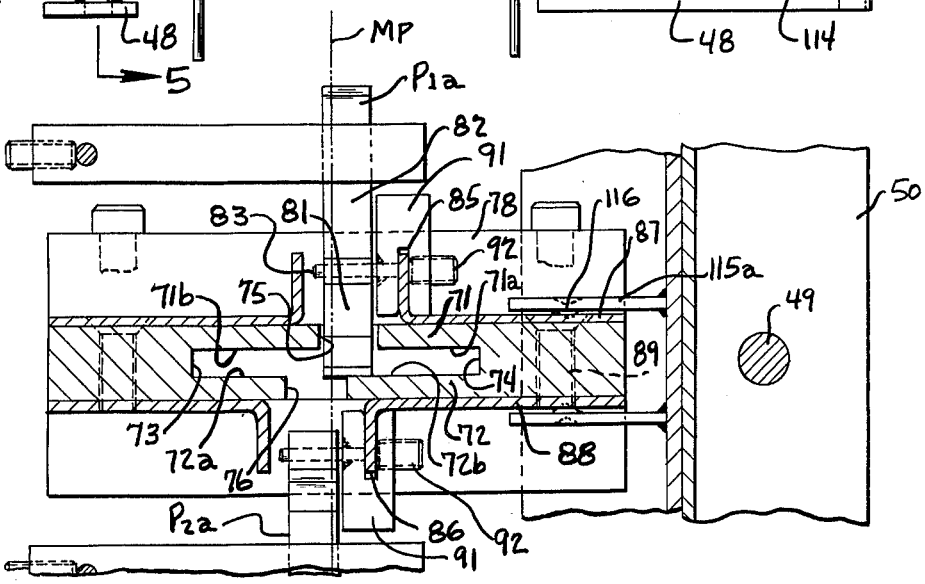
FIG. 4 is a transverse sectional view taken on the plane 4—4 of FIG. 2 and illustrating the parts on a larger scale.

Reference is now made more specifically to the coin responsive mechanism shown in FIGS. 2–9, inclusive. The coin responsive mechanism 41 comprises a generally vertical coin chute having an open upper end positioned to receive coins from the coin slot, after passage through the slug rejector mechanism 63, and an open lower end positioned above the coin stop 48. As best shown in FIG. 4, the coin chute has first and second sidewalls 71 and 72 and first and second end walls 73 and 74. Slots 75 and 76 are formed at opposite sides of the chute in the sidewalls 71 and 72 respectively to extend longitudinally of the chute and the slots are advantageously staggered or offset relative to the medial plane designated MP disposed medially between and parallel to the end walls 73 and 74. Thus, the slot 75 separates the sidewall 71 into sidewall portions 71*a* and 71*b* and similarly the slot 76 separates the sidewall 72 into sidewall portions 72*a* and 72*b*. By reason of the staggered arrangement of the slots 75 and 76, part of sidewall portion 72*b* is disposed opposite the slot 75 in the sidewall 71 and, similarly, part of the sidewall portion 71*b* is disposed opposite the slot 76 in the sidewall 72 to provide stops for the coin gauging pawls described hereinafter. Although the slots are staggered or offset relative to the medial plane MP, they are arranged to extend across or straddle the medial plane, for reasons more fully described hereinafter.

In order to accurately gauge different combinations of coins in the chute, it is necessary to accurately control the spacing between the sidewalls 71, 72 and the end walls 73, 74. In the preferred embodiment shown, the chute is formed from two pieces of metal stock by milling grooves in the stock with the sidewall portion 71*a*, end wall 73, and sidewall portion 72*b* formed in one piece and the sidewall portion 71*b*, end wall 74 and sidewall portion 72*a* formed in the other piece. The pieces are rigidly interconnected at opposite ends by upper and lower tie bars 77 and 78 respectively which are secured to the U-shaped members that form the channel by fasteners 79. Alternatively, the chute could be formed by laminating a plate having a thickness corresponding to the width of the end walls 73, 74 between plates that form the sidewalls. However, it would be necessary to very accurately control the thickness and flatness of such laminated plates. A first set of coin gauging pawls designated generally by a letter P1 are mounted to extend through the slot 75 and one sidewall 71 of the chute for gauging different combinations of coins in the chute and a second set of gauging pawls designated generally by the letters P2 are mounted to extend through the slot 76 in the other sidewall 72 of the chute for gauging other combinations of coins. The number of gauging pawls in each set will vary dependent on the different combinations of coins to be sensed by the coin responsive mechanism and, in the embodiment shown, the first set of gauging pawls includes three pawls P1*a*–P1*c* and the second set also includes three pawls designated P2*a*–P2*c*, it being understood that a greater or lesser number of gauging pawls can be utilized in each set.

Figure 9:
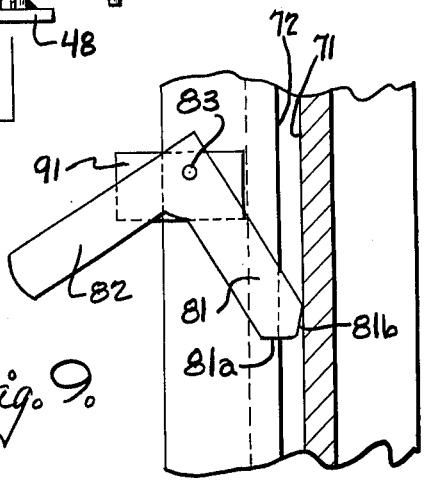
FIG. 9 is a fragmentary longitudinal sectional view through the coin chute of the coin responsive mechanism illustrating one of the gauging pawls on a larger scale.

Each of the gauging pawls have the same construction and the same numerals are used to designate corresponding parts. The gauging pawls have a generally L-shaped configuration including first and second legs 81 and 82 extending at approximately right angles to each other and which are pivotally mounted adjacent the juncture of the legs on a pivot pin 83 so that one leg 81 of each of the pawls is arranged to extend through the respective slot in the sidewall of the chute while the other leg extends laterally outwardly to normally gravitationally urge the leg 81 of the pawl into the chute. As will be seen, the legs 81 on the pawls P1*a*–P1*c* are adapted to extend through the slot 75 in the sidewall 71 and crosswise of the chute into engagement with that part of the wall portion 72*b* of the wall 72 that is opposite the chute 75. Similarly, the legs 81 of the pawls P2*a*–P2*c* are adapted to extend through the slot 76 in sidewall 72 and crosswise of the chute into engagement with a part of the wall portion 71b at the other side of the chute. Thus, the portion of the sidewall 72 which is opposite the slot 75 in sidewall 71 provides a stop for the pawls P1*a*–P1*c* of the first set and, similarly, the portion of the walls 71 that is opposite the slot 76 in the wall 72 provides a stop for the second set of pawls P2*a*–P2*c*. As best shown in FIG. 9, the legs 81 of the pawls have a coin stop face 81*a* at their lower ends arranged to engage the upper edge of a coin in the chute to limit upward movement thereof and the coin engaging faces are advantageously made sufficiently wide so as to extend across or straddle the medial plane MP between the end walls 73 and 74 of the chute. The lower end of the leg 81, however, has a nose portion 81*b* that is beveled slightly so as to space the coin stop face 81*a* from the opposite wall of the chute a distance less than the thickness of a dime and sufficient to prevent the coin stop face 81*a* from engaging the upward edge of a coin, if another coin is disposed between nose portion 81*b* of the pawl and the opposite side of the slot. In this manner, the coin engaging pawl will limit upward movement of a combination of coins only if the uppermost coin of the combination is adjacent the stop face 81*a*, and the pawl will not prevent upward movement of the coins if additional coins are deposited in the chute to a level above the nose of the pawl, for example as shown adjacent pawl P2*a* in FIGS. 7 and 8.

The coin engaging pawls are mounted for adjustment lengthwise of the respective slot to enable sensing of different coin combinations and for this purpose pairs of pawl mounting flanges 85 and 86 are provided adjacent the slots 75 and 76 respectively to extend laterally outwardly therefrom. The flanges 85 and 86 are conveniently formed integrally with mounting plates 87 and 88 respectively that are attached to the chute as by fasteners 89. In the embodiment of FIGS. 2–9, the pivot pins 83 for the pawls are attached to generally U-shaped yokes 91 that straddle one of the flanges 85 or 86 and which are secured in adjusted position therealong by a screw 92 threaded in one leg of the yoke and engageable with the flange 85 when the screw is tightened. The pawl pivot pin is rigidly secured to the other leg of the yoke 91 and extends in cantilever fashion therefrom generally parallel to the respective sidewall of the chute to pivotally support the pawl thereon.

Figure 10:
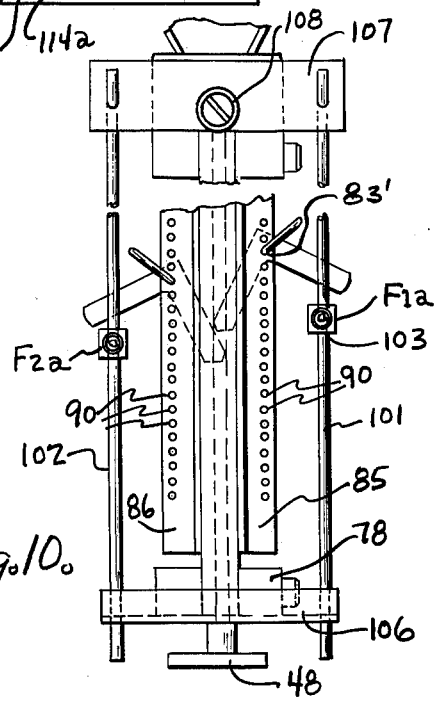
FIG. 10 is a fragmentary front elevational view of a modified form of coin responsive mechanism.
Figure 11:
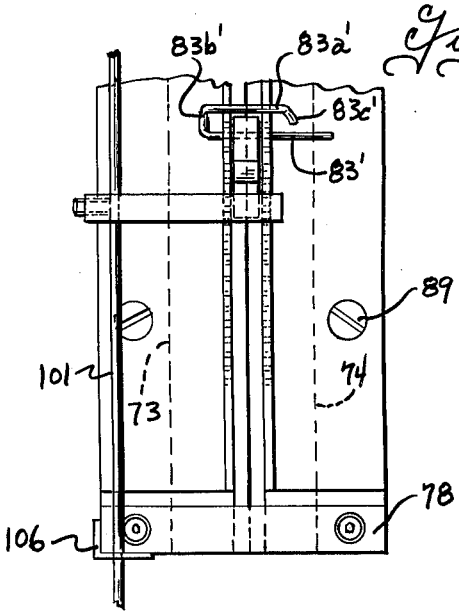
FIG. 11 is a fragmentary side elevational view of the embodiment of FIG. 10.

A modified pawl mounting arrangement is illustrated in the embodiments of FIGS. 10 and 11. The embodiment of FIGS. 10 and 11 is generally the same as that previously described in connection with FIGS. 2–9 and like numerals are used to designate corresponding parts. In the embodiments of FIGS. 10 and 11, however, the pairs of pawl mounting flanges 85 and 86 are provided with rows of transversely aligned pawls 90 and the pawls are adjustably mounted on the flanges by inserting a pivot pin 83' through the openings 90 and through the pawl, at a selected location along the pawl mounting flanges. The pivot pins 83' are advantageously also arranged to limit upward swinging movement of the pawls and, for this purpose, are formed with a generally U-shaped configuration with a second leg portion 83*a'* connected as at 83*b'* to one end of the pin. The leg portion 83*a'* extends in laterally spaced relation to the pin 83' and overlying relation to the leg 82 of the respective pawl. Thus, the leg portion 83*a'* of the pin is positioned so as to extend between the leg 82 of the pawl and the pawl mounting flanges to limit upward swinging movement of the pawl. A locking portion 83*c'* (FIG. 11) is advantageously formed on the end of the leg portion 83*a'* to extend laterally thereof and engage the pawl mounting flange, to thereby prevent accidental withdrawal of the pivot pin 83'.

The spacing between the sidewall 71 and 72 and the spacing between the end walls 73 and 74 of the chute is made such as to allow the single chute to accommodate coins of several different denominations and size. In particular, it has been found that a coin responsive mechanism utilizing a single chute can be made for sensing various different combinations of nickels, dimes and quarters by accurately spacing the end walls 73 and 74 of the chute a distance only slightly greater than the diameter of a quarter to guidably receive a quarter therebetween, and by spacing the sidewalls 71 and 72 of the chute apart a distance only slightly greater than the thickness of a nickel but less than twice the thickness of a dime so as to guidably receive nickels therebetween. In particular, it has been found that the sidewalls should be spaced apart a distance substantially equal to .083 inches and that the end walls should be spaced apart a distance substantially equal to 31/32 inches. Some stacked combinations of pennies will have the same height as some stacked combinations of dimes and nickels and the coin rejector mechanism 63 is accordingly selected to be of a type that will reject pennies as well as other slugs and to pass only dimes, nickels, and quarters to the coin responsive mechanism. Such slug ejector mechanisms are well known and may, for example be of a type sold by National Rejectors, Inc., St. Louis, Miss. As previously described, the slots 75 and 76 are offset from the medial plane MP but do extend across the medial plane. The slots are conveniently formed with a width approximately 6/32 of an inch and are offset from the medial plane such that the wall portion 71*b* is substantially 14/32 of an inch and the wall portion 71a is substantially 11/32 inches. The width of wall portions 72*a* and 72*b* respectively correspond to the width of wall portions 71*a* and 71*b*. Thus, wall portions 71*b* and 72*b* would overlap the slots in the opposite sidewalls by an amount approximating 3/32 of an inch to provide stops for the pawls.

Figure 2:
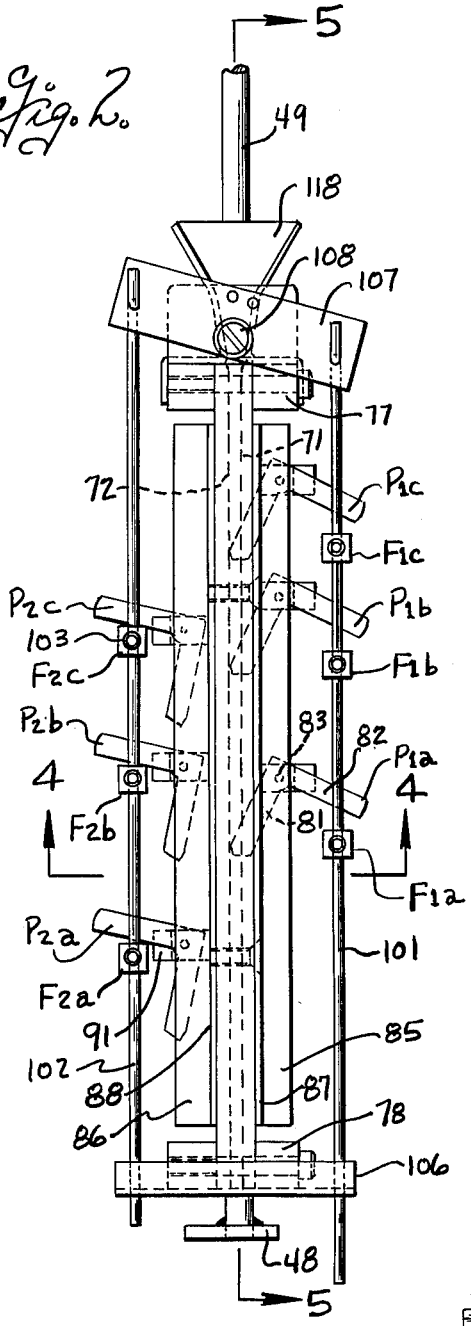
FIG. 2 is a front elevational view of the coin responsive mechanism illustrating the same in one operational mode.
Figure 3:
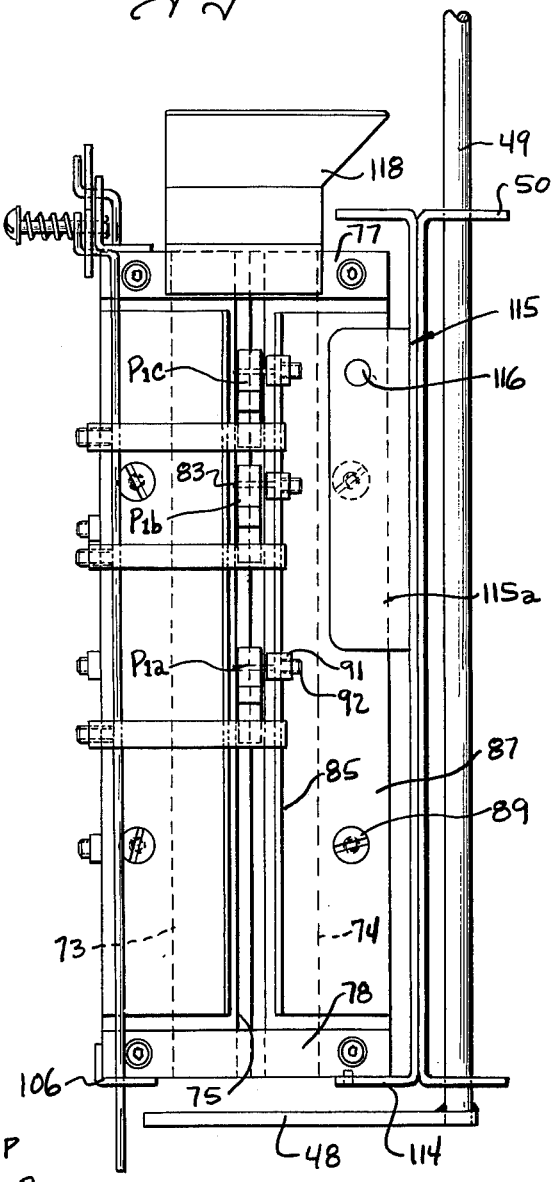
FIG. 3 is a side elevational view of the coin responsive mechanism of FIG. 2.
Figure 7:
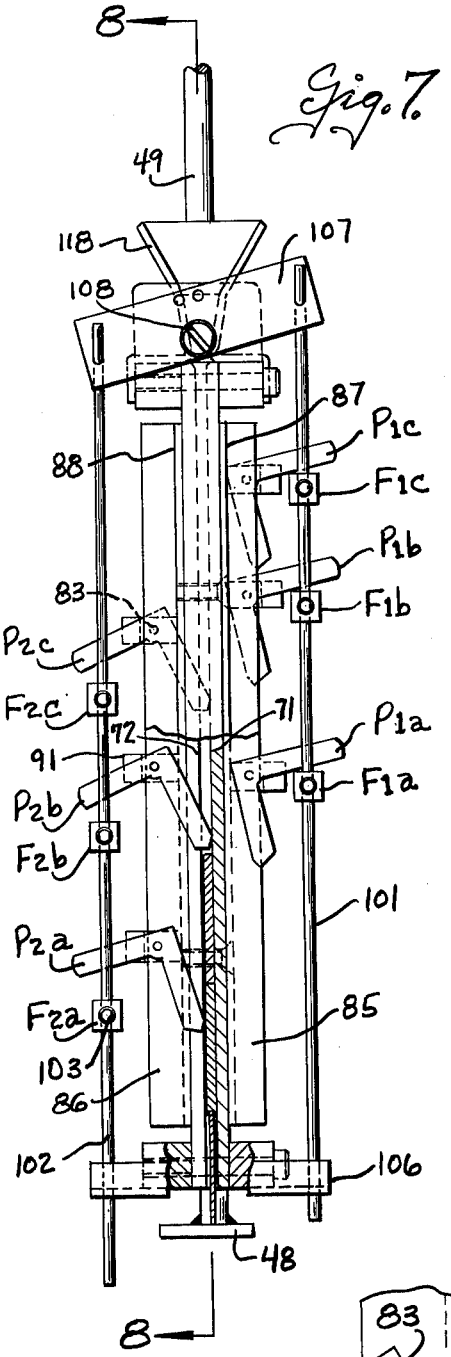
FIG. 7 is a front elevational view of the coin responsive mechanism adapted for an operational mode different from FIG. 2.
Figure 8:
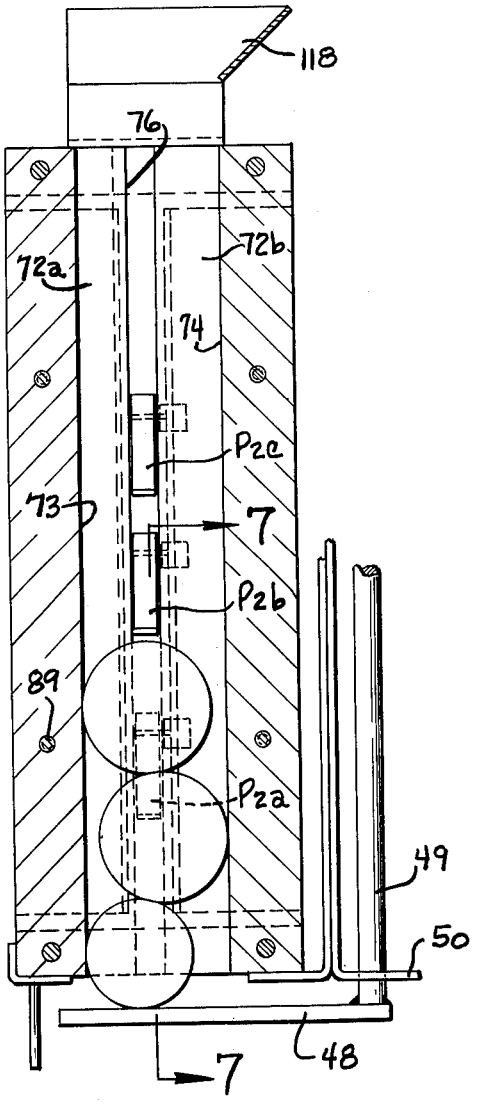
FIG. 8 is a sectional view taken on the plane 8-8 of FIG. 7 illustrating the coin responsive mechanism with a coin combination having a total monetary value different from that in FIGS. 5 and 6.

The coin responsive mechanism having pawls extending into the chute from opposite sides is adapted to respond to a large number of different coin combinations including different coin combinations whose stacking height differs from each other by relatively small amounts. Moreover, the coin responsive mechanism is readily adapted for two mode operation, that is to sense different coin combinations having one total monetary value, for example when dispensing daily newspapers, and to sense different coin combinations having a different total monetary value, for example when dispensing Sunday papers. As shown, a pair of control rods 101 and 102 are mounted to generally parallel the slots 75 and 76 respectively, and a plurality of fingers designated F1*a*–F1*c* are mounted for adjustment along rod 101 and a similar plurality of fingers F2*a* are mounted for adjustment along rod 102. The fingers are conveniently locked in adjusted position by set screws 103 that are threaded in the respective fingers and are adapted to be tightened to engage the rods. Rods 101 and 102 are guided at their lower ends in a bracket 106 attached to the lower end of the coin chute and are pivotally connected at their upper ends to a lever 107 that is pivotally supported intermediate its ends on a pivot 108 on the coin chute. The lever 107 is thus pivotal about an axis intermediate the rods 101 and 102 from a first position as shown in FIG. 2 in which one rod 101 is lowered while the other rod 102 is raised, to a second position as shown in FIG. 7 in which the rod 101 is raised and the rod 102 is lowered. Fingeres F2*a*–F2*c* can be adjusted to positions as shown in FIG. 2 to engage the legs 82 of the pawls P2*a*–P2*c* to move the pawls to an inoperative position when the lever 107 is in the position shown in FIG. 2. Similarly, the fingers F1*a*– F1*c* can be adjusted along the rod 101 to positions in which they will engage the legs 82 on pawls P1*a*–P1*c*, when the rod 101 is in its raised position as shown in FIG. 7, to move pawls P1*a*–P1*c* to an inoperative position. Thus, the lever 107 can be moved to positions in which it alternately renders pawls P1*a*–P1*c* and pawls P2*a*–P2*c* inoperative while the other pawls are moved to their operative position. The lever 107 is advantageously also arranged to move to an intermediate position as shown in FIG. 10 in which the fingers on the rods 101 and 102 do not engage either of the pawls. This position can be used when it is desired to have pawls at both sides of the chute operative to sense different coin combinations.

By the way of example, the pawls P1*a*–P1*c* have been adjusted to sense different combinations of dimes, nickels, and quarters which will total 45 cents, a currently typical price for a Sunday paper and pawls P2*a* –P2*c* have been adjusted to sense different combinations of coins totaling twenty cents, a currently typical price for a daily newspaper. In particular, pawl P1*a* is arranged to sense a combination of a quarter and two dimes; pawl P1*b* a combination of four dimes and a nickel; and pawl P1*c* the combination of three dimes and three nickels. Pawl P2*a* is arranged to sense a combination of two dimes; pawl P2*b* a combination of one dime and two nickels; and pawl P2*c* the combination of four nickels. The lever 107, when moved to the position shown in FIG. 2, will deactivate pawls P2*a*–P2*c* and activate pawls P1*a*–P1*c* to adapt the apparatus for measuring different coin combinations totaling forty-five cents to dispense a Sunday paper. By merely moving the lever 107 to the position shown in FIG. 7, pawls P1*a*–P1*c* are deactivated and pawls P2*a*–P2*c* are activated to sense different combinations totaling twenty cents for dispensing a daily newspaper.

There are some different coin combinations having the same total monetary value which have very similar stacking heights in the coin chute. For example, the stacking height of a quarter and a nickel in the coin chute is only slightly less than the stacking height of three dimes. It is desirable to be able to sense such different combinations having similar stacking heights and pawls can be located at opposite sides of the coin chute to sense different coin combinations having the same total monetary value but only a slightly different total stacking height in the chute. For example, as shown in FIG. 9, pawl P2*a* is adjusted to sense the combination of a quarter and a nickel and pawl P2*b* is adjusted to sense a combination of three dimes. Lever 107 is adjusted to an intermediate position so as to activate both the pawls P1*a* and P2*a* so that pawls at both sides of the chute are operative to sense different coin combinations.

Figure 5:
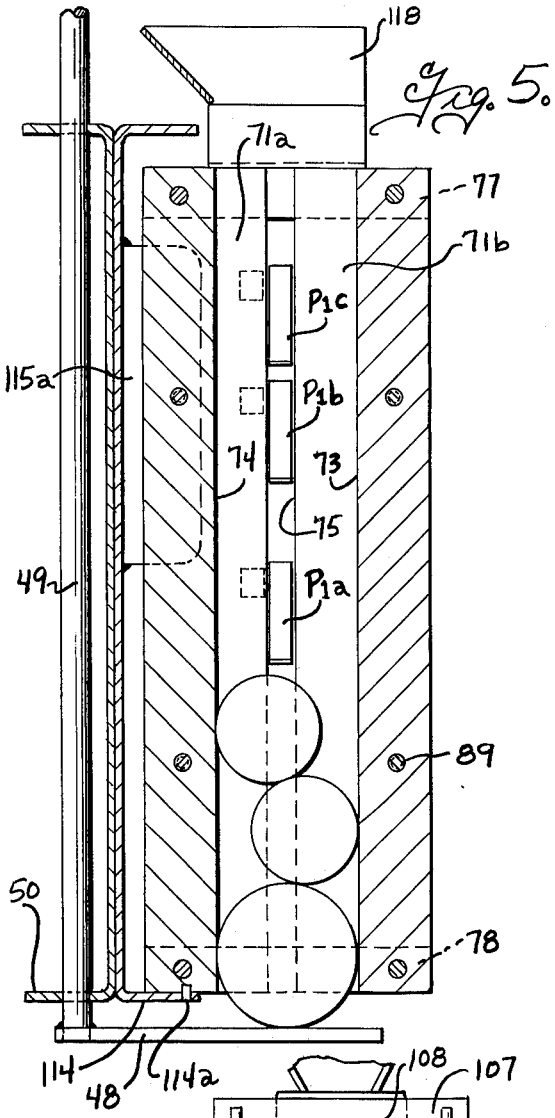
FIG. 5 is a longitudinal sectional view of the coin responsive mechanism taken on the plane 5—5 of FIG. 2 and illustrating the same with one combination of coins having a preselected monetary value.
Figure 6:
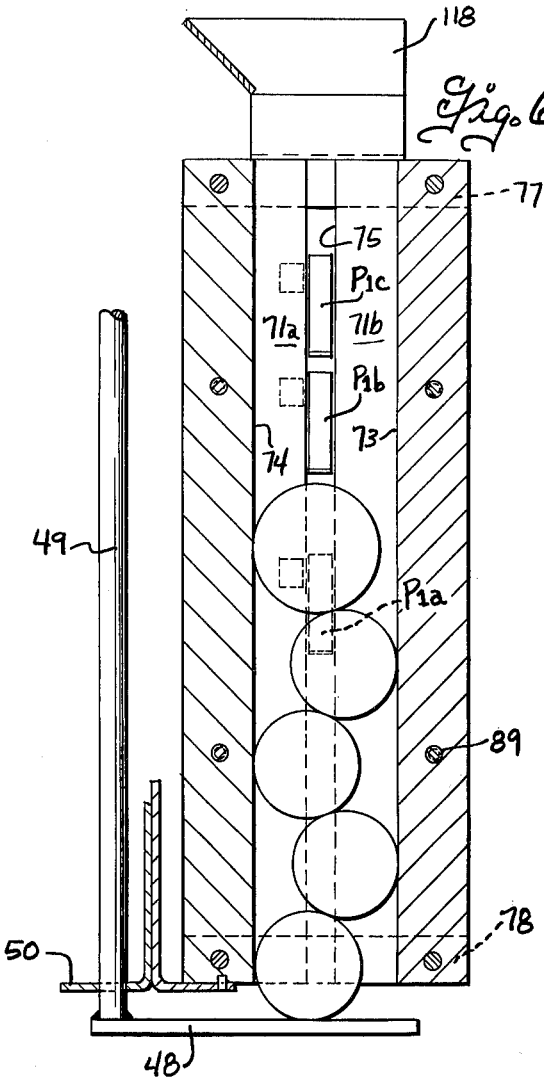
FIG. 6 is a vertical sectional view taken on the plane 5—5 of FIG. 2 illustrating the coin responsive mechanism with a different combination of coins having the same monetary value as in FIG. 5.

The coin responsive mechanism is conveniently detachably mounted on the dispensing machine at a location intermediate the outlet of the slug rejector 43 and the coin stop 48. As shown, a bracket 114 is mounted on the vending machine housing and is formed with an upwardly extending pin 114*a* that is adapted to extend into an opening in the lower end of the coin responsive mechanism, as best shown in FIGS. 5 and 6. A generally U-shaped bracket having legs 115*a* that straddle opposite sides of the coin responsive mechanism is mounted on the housing at a location adjacent the upper end of the mechanism and with detents 116 formed in the legs 115*a* arranged to engage into recesses in opposite sides of the coin responsive mechanism to releasably retain the same in position. A coin guide 118 is conveniently attached to the upper end of the coin responsive mechanism to aid in guiding coins from the slug rejector 63 into the coin responsive mechanism.

From the foregoing it is felt that the construction and the use of the coin responsive mechanism will be more readily understood. The coin responsive mechanism is mounted in the vending machine at a location between the coin stop 48 and the outlet of the slug rejector 38 to provide a vertical drop for coins onto the coin stop 48. When a combination of different coins is desposited in the coin chute to provide a total stack height just below the coin engaging face on one of the pawls, that pawl will be operative to prevent upward movement of the coin combination in the chute. Thus, when the dispenser is moved fowardly in a dispensing stroke, the coin combination in the coin chute will prevent upward movement of the coin stop 48 and will therefore hold the latch finger 42 in an inoperative position so that the dispenser can be moved to a full dispensing stroke. Toward the end of the dispensing stroke, the cam portion 45*d* engages the latch finger 42 to raise the same and hence depress the coin stop 48. This allows the coins in the chute to be discharged from the chute and readies the apparatus for a succeeding dispensing cycle. As will be understood, the coin stop can also be arranged to swing out of the position below the coin chute in order to aid in the discharge of coins therefrom.

If the total stacked height of the coins in the chute does not position the upper edge of the uppermost coin in the stack closely adjacent the underside of one of the operative pawls, the pawls will not hold the stack against upward movement and, when the dispenser is moved forwardly in a dispensing stroke, the coin stop 48 can move upwardly and allow the latch finger 42 to move into the notch 45*b* and lock the dispenser against dispensing. As previously described, the nose portion 81*b* of the pawls is rounded so as to enable the stop face 81*a* to engage the upper edge of the uppermost coin in the stack but will cam over the upper edge of a coin below the top of the stack. In other words, if the total coins in the stack are such that a coin is interposed between the nose portion 81*b* and the opposite sidewall of the chute, the pawl will not be effective to prevent upward movement of the coins and coin stop.

Although preferred embodiments of the invention have been described, it is to be understood that other forms, modifications and adaptations can be made within the scope of the following claims.

The embodiments of the invention in which an exclusive property or privilege is claimed are defined as follows:

1. A coin responsive mechanism for use in dispensing machines of the type having a coin stop for controlling a dispensing operation, said coin responsive mechanism including a generally vertical coin chute having first and second parallel sidewalls and first and second parallel end walls extending between the sidewalls with the side and end walls spaced apart to receive coins of several different denominations and to provide a gravity drop of coins to the coin stop, said first and second sidewalls respectively having first and second slots extending lengthwise thereof intermediate the end walls of the chute, said first and second slots in said first and second sidewalls being offset in opposite directions relative to a medial plane that is parallel to and equidistant from said first and second end walls whereby a portion of said second sidewall is disposed opposite said first slot and a portion of said first sidewall is disposed opposite said second slot, a first gauging pawl means mounted for movement through said first slot into said chute and having an end portion extending across said chute into engagement with said portion of said second sidewall to block upward movement of at least one preselected combination of coins in the chute, and a second gauging pawl means mounted for movement through said second slot into said chute and having an end portion extending across said chute into engagement with said portion of said first sidewall to block upward movement of at least one other combination of coins in said chute, said first and second slots each overlapping said medial plane, said first and second pawl means each having coin abutment faces on said end portions thereof that overlap said medial plane.

2. A coin responsive mechanism as set forth in claim 1 wherein said end walls of said chute are spaced apart substantially 31/32 inches and said sidewalls are spaced apart substantially 0.083 inches whereby said chute will pass coins of quarter, nickel and dime denominations while preventing passage of any of those coins in side-by-side relation, and coin rejector means ahead of said chute of a type which will pass only quarters, nickels and dimes.

3. A coin operated dispensing mechanism as set forth in claim 1 wherein said first and second sidewalls each have a transversely extending flange along the respective first and second slots, a U-shaped clamp mounted on each of said flanges for adjustment therealong and having means for releasably securing the same in adjusted position, and means pivotally mounting said first and second gauging pawl means on a respective one of said U-shaped clamps.

4. A coin operated dispensing mechanism as set forth in claim 1 wherein said first and second sidewalls each have transversely extending flanges along each side of the respective first and second slots therein, said flanges on each sidewall having a row of spaced apertures therealong, and pin means extending parallel to the sidewalls of the chute through selected ones of the apertures and through a respective pawl means for pivotally mounting the pawl means on the flanges at different adjusted positions therealong.

5. A coin responsive mechanism according to claim 1 wherein said coin chute comprises a pair of channel-shaped members each including one end wall and portions of said first and second sidewalls rigidly interconnected to each other, said portions of said first and second sidewalls on each channelshaped member having relatively different widths and said channelshaped members being disposed in opposed relation to form said chute and having their adjacent edges spaced apart to define said first and second slots in the first and second sides of the chute, and means adjacent opposite ends of the pair of channel-shaped members for rigidly interconnecting the same.

6. A coin responsive mechanism for use in dispensing machines of the type having a coin stop for controlling a dispensing operation, said coin responsive mechanism including a generally vertical coin chute having first and second parallel sidewalls and first and second parallel end walls extending between the sidewalls with the side and end walls spaced apart to receive coins of several different denominations and to provide a gravity drop of coins to the coin stop, said first and second sidewalls respectively having first and second slots extending lengthwise thereof intermediate the end walls of the chute, a first gauging pawl means mounted for movement through said first slot into said chute to block upward movement of at least one preselected combination of coins in the chute, and a second gauging pawl means mounted for movement through said second slot into said chute to block upward movement of at least one other combination of coins in said chute, said first pawl means including at least several individual pawls mounted for independent adjustment to different positions along the first slot to block upward movement of several different combinations of coins in the chute having a first preselected total monetary value, said second pawl means includes at least several individual pawls mounted for independent adjustment to different positions along the second slot to block upward movement of several different combinations of coins in the chute having a second preselected total monetary value, and selector means engageable alternately with said first pawl means and said second pawl means for moving the same to an inoperative position out of the chute, said selector means including first and second rods respectively extending alongside said first and second sidewalls, a lever swingably mounted intermediate its ends and having first and second end portions respectively connected to said first and second rods for simultaneously moving the same in relatively opposite directions, and means on the said first and second rods for respectively engaging said first and second pawl means.

7. A coin responsive mechanism for use in dispensing machines of the type having a coin stop for controlling a dispensing operation, said coin responsive mechanism including a generally vertical coin chute having first and second parallel sidewalls and first and second parallel end walls extending between the sidewalls with the side and end walls spaced apart to receive coins of several different denominations and to provide a gravity drop of coins to the coin stop, said first and second sidewalls respectively having first and second slots extending lengthwise thereof intermediate the end walls of the chute, said first and second slots in said first and second sidewalls being offset in opposite directions relative to a medial plane that is parallel to and equidistant from said first and second end walls whereby a portion of said second sidewall is disposed opposite said first slot and a portion of said first sidewall is disposed opposite said second slot, a first gauging pawl means mounted for movement through said first slot into said chute and having an end portion extending across said chute into engagement with said portion of said second sidewall to block upward movement of at least one preselected combination of coins in the chute, and a second gauging pawl means mounted for movement through said second slot into said chute and having an end portion extending across said chute into engagement with said portion of said first sidewall to block upward movement of at least one other combination of coins in said chute, said first and second gauging pawl means each including a pawl of generally L-shaped configuration, said first and second sidewalls each having a pair of transversely extending flanges along opposite sides of the respective first and second slots therein, said flanges on each sidewall having a row of spaced apertures therealong, a pin extending parallel to the sidewalls of the chute through selected ones of the apertures and through a respective pawl for pivotally mounting each pawl on a respective pair of flanges at different adjusted positions therealong with one leg of each pawl extending downwardly and the other leg of each pawl extending outwardly, and each pin having a portion attached to one end thereof and overlying said other leg of the respective pawl for limiting upward movement thereof.

* * * * *